United States Patent [19]

Woychick

[11] 4,292,701

[45] Oct. 6, 1981

[54] WATER BED CONSTRUCTION WITH ENCLOSURE

[75] Inventor: John Woychick, Wayzata, Minn.

[73] Assignee: Land-O-Nod, Minneapolis, Minn.

[21] Appl. No.: 112,535

[22] Filed: Jan. 16, 1980

[51] Int. Cl.[3] ..... A47C 27/08

[52] U.S. Cl. ..... 5/422; 5/451; 5/470

[58] Field of Search ..... 5/451, 452, 422, 470, 5/471, 450

[56] References Cited

U.S. PATENT DOCUMENTS

| | | | |
|---|---|---|---|
| 3,736,604 | 6/1973 | Carson | 5/422 |
| 3,742,531 | 7/1973 | Alsbury et al. | 5/451 |
| 3,789,442 | 2/1974 | Tobinick | 5/450 |
| 4,149,286 | 4/1979 | Fogel | 5/451 |
| 4,186,457 | 2/1980 | Amelung | 5/427 |

*Primary Examiner*—Alexander Grosz

*Attorney, Agent, or Firm*—James R. Cwayna

[57] ABSTRACT

A water bed construction which includes a water and air containing bladder and an innerspring support for the same, the bladder and support combination being enclosed within a covering, the covering material being removable from the combination. The entire assembly giving the appearance of a standard innerspring, mattress combination.

3 Claims, 3 Drawing Figures

WATER BED CONSTRUCTION WITH ENCLOSURE

FIELD OF THE INVENTION

This invention relates generally to the areas of bedding, particularly to water beds and more specifically within the water bed area to water beds which employ a flexible support surface and having a removable covering completely enveloping the support and water bladder.

BACKGROUND AND OBJECTS OF THE INVENTION

Water beds normally consist of a water bladder of a predetermined rectangular size and of a predetermined thickness mounted upon a relatively rigid surface with the surface having upstanding sides to retain the bladder in position thereon.

In applicant's study of the prior art which includes the water beds that are presently being manufactured and sold, he has failed to find any water bed constructions that resemble what may be termed a standard, mattress, box spring construction and which include a ticking covering completely enclosing the bladder and flexible support in the manner he has provided and which is disclosed in this application.

With the unit as provided herein, the applicant affords a particularly comfortable sleeping surface in that a bladder for retaining the water is placed upon a flexible support such an innerspring mattress. Such a combination provides, in essence, a box spring, mattress combination with the bladder replacing the foam rubber or padded mattress. A particular advantage of this combination is that the user will not "bottom out" against a relatively hard surface as does happen should the person be particularly heavy, the bladder not be properly filled or the person drops heavily onto the bladder.

It is therefore an object of the applicant's invention to provide a water bed construction which includes a water retaining bladder and a flexible supporting member to support the same.

It is therefore an object of the applicant's invention to provide a water bed construction which includes a water retaining bladder and a flexible supporting member, such as a box spring, for supporting the bladder.

It is a further object of the applicant's invention to provide a water bed construction which includes a water retaining bladder and a box spring for supporting the same, the entire combination being enclosed with a covering material.

It is still a further object of the applicant's invention to provide a water bed construction which includes a water retaining bladder and a box spring for supporting the same, the entire combination being enclosed in a removable covering, ticking material.

These and other objects and advantages of the invention will more fully appear from the following description made in connection with the accompanying drawings in which the same numeral is used to designate the same or similar parts throughout the several views, and in which.

Figure 1:
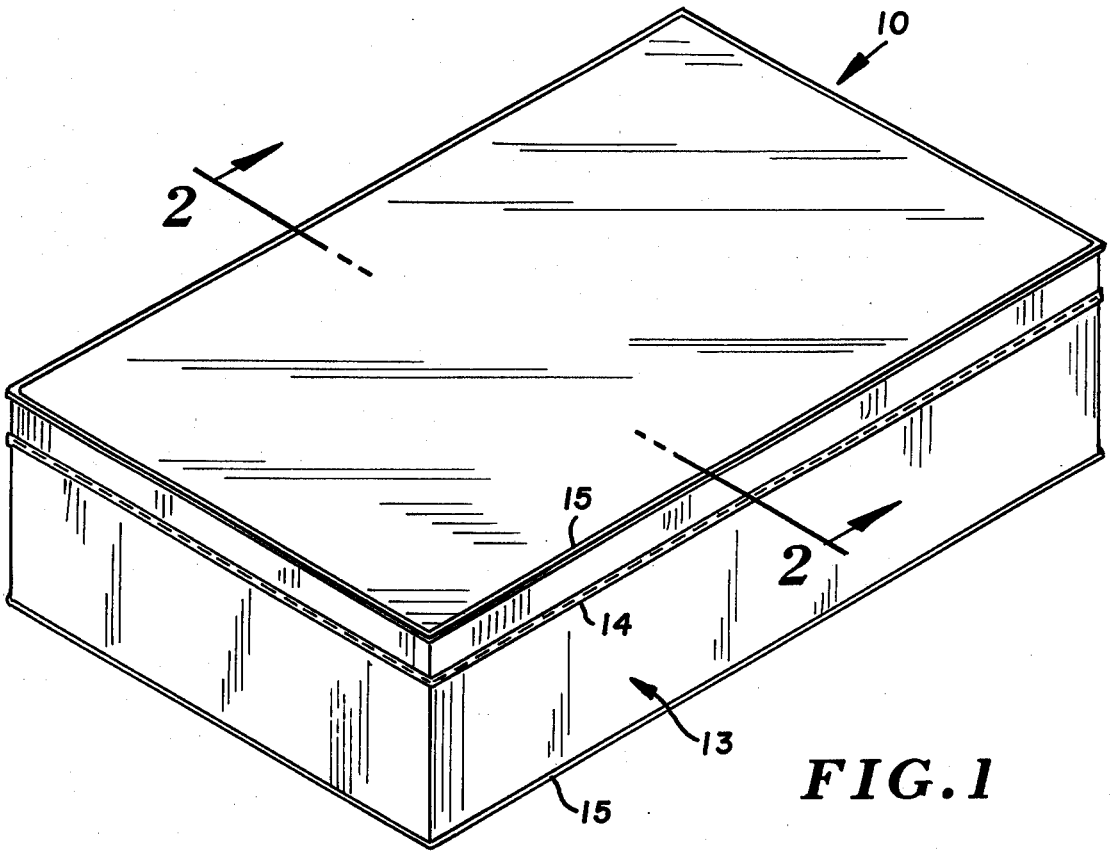
FIG. 1 is a perspective view of a water bed embodying the concepts of the applicant's invention.
Figure 2:
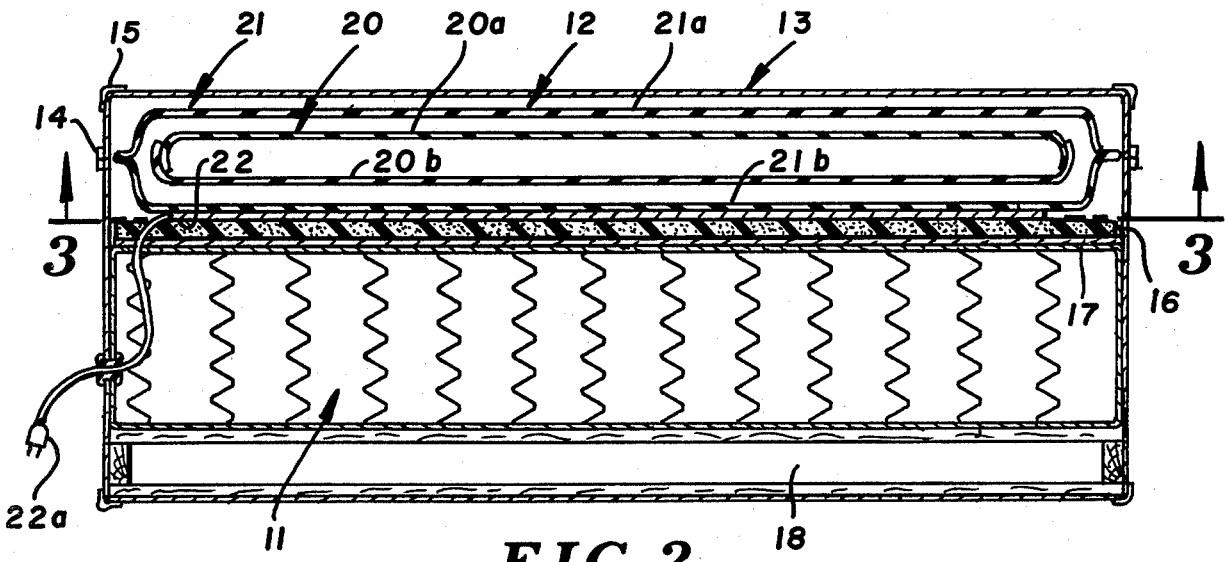
FIG. 2 is a vertical section taken substantially along Line 2—2 of FIG. 1; and, FIG. 3 is a section taken substantially along Line 3—3 of FIG. 2.

In accordance with the accompanying drawings, applicant's water bed construction is designated in its entirety 10 and the device, as particularly illustrated in the cross section of FIG. 2 includes a flexible inner spring support member 11, the bladder member 12 and the external covering 13, which covering is known in the industry as ticking. The ticking is removably arranged about the internal components 11, 12 through a zipper or other closure arrangment 14. The ticking is provided with supporting corner elements 15, as is well known in the art.

In the particular construction employed by the applicant, an additional padding member of foam rubber or the like 16 may be provided and the unit may also include a relatively rigid pad 17 interposed between the foam pad 16 and the upper surface of the box spring 11. Similarly, a bottom frame structure 18 is provided to support the inner spring construction and this frame permits the entire unit to rest upon the frame rails of a bed. With the construction as illustrated herein, the applicant's unit may be utilized with standard bed frame constructions.

The inner spring unit is of standard construction and no further description of the same is deemed necessary.

The construction of the bladder 12 is more specifically detailed in a copending application for United States Letters Patent for which the applicant herein is a joint inventor. The title of such application is WATER BED BLADDER having a filing date of Jan. 16, 1980 and bearing Ser. No. 06/112,536.

For the purposes of the disclosure herein, the bladder 12 includes an internal water retaining bag element 20 having an upper **20*a* and a lower 20*b* surface joined about the periphery thereof with a selected lap seal. The bladder 12 further includes an enveloping air and water impervious unit having an upper 21*a* surface and a bottom 21*b*** surface which is joined about the peripheries thereof through a selected butt seal.

As disclosed in the copending application, means for filling the internal water retaining bladder 20 through the enveloping, exterior bladder 21 must be provided and both of these bladders are respectively sealed against the filling element. In the form shown, the exterior bladder 21 has been filled with air, but, as disclosed in such copending application, this exterior bladder may be evacuated of air or may simply be at atmospheric pressure and these latter two situations would require that the ticking covering be proportionately reduced in size such that a relatively close and positioning fit for the bladder is maintained by the exterior ticking 13. These latter considerations are not believed to depart from the scope of the invention as theprimary invention is to provide a water retaining bladder upon a flexible support such as a box inner spring with the combination thereof being enclosed with the removable ticking material.

Figure 3:
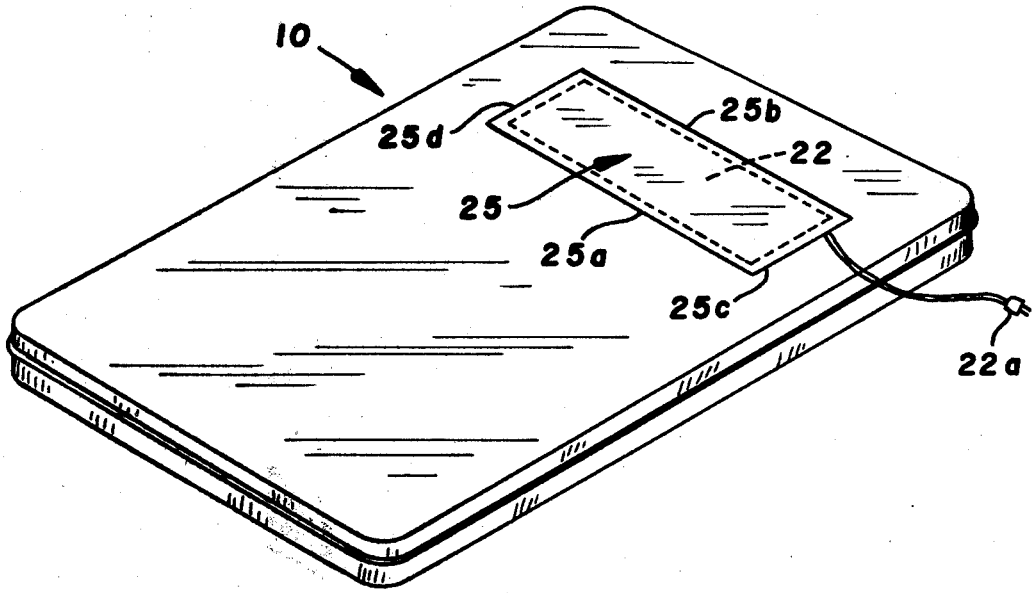

As further illustrated in FIGS. 2 and 3, a heater element 22 having an electrical connector **22*a* may be provided in close association to the bladder 12 for heating of the water contained therein. As illustrated in FIG. 3, a pocket area is formed by providing a material sealably compatible with the material of the exterior bladder 21 and sealing the same thereto around at least selected portions of the same. The pocket forming material is designated 25 and is, in the form shown, sealed to the exterior bladder 21 about sides 25*a*, 25*b*, 25*c* with side 25***c* being provided with an unsealed portion to allow the cord 22*a* of the heater 22 to pass therethrough. By allowing the side 25*d* to be unsealed, the heater element may be easily inserted and removed from the pocket 25.

In comparison to existing water bed constructions which employ a relatively hard surface for the water bladder, it should be obvious that the utilization of the inner spring construction and the resulting relatively flexible support surface provide several advantages. One particular advantage that has not been mentioned is the usability of a relatively thin water bladder. Such advantage results in production cost savings and a weight factor for useage due to the decreased volume of water that is required to fill the bladder. This latter weight factor has become an important consideration as certain building have limited the use of water beds.

One additional advantage with the concept of the bladder of applicant's device is the limitation of wave effect. When utilizing relatively thick bladders, movement of a body thereon may cause an undesirable wave effect.

It should be obvious that the applicant has provided a unique total construction for a water bed which is usable with standard bed frames having the desirable qualities of a water bed while resembling what is known as a standard box spring and mattress combination.

What I claim is:

1. A water bed construction including:

a. support frame;

b. a flexible inner spring support member arranged on said frame;

c. a water retaining member arranged upon the upper surface of said inner spring support member;

d. said water retaining member including a first water retaining portion surrounded and enveloped by an air and water impervious member having pocket means, with a removable heater, formed on its lower exterior surface; and e. an enclosure member surrounding at least said inner spring support member and said water retaining member.

2. The structure set forth in claim 1 and said enclosure member including access means for the removal and insertion of said water retaining bladder member.

3. The structure set forth in claim 2 and said access means including zipper means for opening and closing said access means.

* * * * *